US005125494A

United States Patent [19]

Nurnberg et al.

[11] Patent Number: 5,125,494

[45] Date of Patent: Jun. 30, 1992

[54] HANDRAIL DRIVE MECHANISM FOR A PASSENGER CONVEYOR

[75] Inventors: Thomas R. Nurnberg, Bettendorf; Kenneth J. Smith, Princeton, both of Iowa

[73] Assignee: Montgomery Elevator Company, Moline, Ill.

[21] Appl. No.: 754,384

[22] Filed: Sep. 3, 1991

[51] Int. Cl.[5] ..... B66B 21/00

[52] U.S. Cl. ..... 198/331; 198/330

[58] Field of Search ..... 198/330, 331

[56] References Cited

U.S. PATENT DOCUMENTS

| | | | |
|---|---|---|---|
| 1,034,841 | 8/1912 | Seeberger et al. | 198/330 X |
| 3,651,919 | 3/1972 | Vollmer | 198/331 |
| 3,677,388 | 7/1972 | Boltsek et al. | 198/330 X |
| 3,749,224 | 7/1973 | Engeler | 198/331 |
| 4,535,880 | 8/1985 | Boltsek | 198/331 X |
| 4,580,675 | 4/1986 | Boltsek | 198/331 |

*Primary Examiner*—Robert P. Olszewski
*Assistant Examiner*—James R. Bidwell
*Attorney, Agent, or Firm*—Wood, Phillips, VanSanten, Hoffman & Ertel

[57] ABSTRACT

A drive pulley system is provided for a handrail drive mechanism of a passenger conveyor. The system includes a pulley, with a handrail drive belt wrapped about the pulley for rotation therewith. A pair of disc-like members are disposed on opposite sides of the pulley to sandwich the pulley therebetween. The disc-like members have diameters greater than that of the pulley and are rotatable relative to the pulley, or the disc-like members may be fixed to the pulley and be fabricated of low friction material. The handrail is wrapped about the outer peripheries of the disc-like members, spacing the handrail from the drive belt, and thereby allowing differential linear movement between the handrail drive belt and the handrail due to the relative rotation between the disc-like members and the pulley, or due to slippage between the handrail and the low friction disc-like members. The system also includes an idler pulley disposed in an area between the pulley and a second pulley and about which both the handrail drive belt and the handrail drive are wrapped to impart drive to the handrail by the drive belt. The idler pulley substantially spans the area between the other two pulleys to provide a large included angle of engagement between the idler pulley, the handrail and the handrail drive belt.

20 Claims, 1 Drawing Sheet

Fig. 1
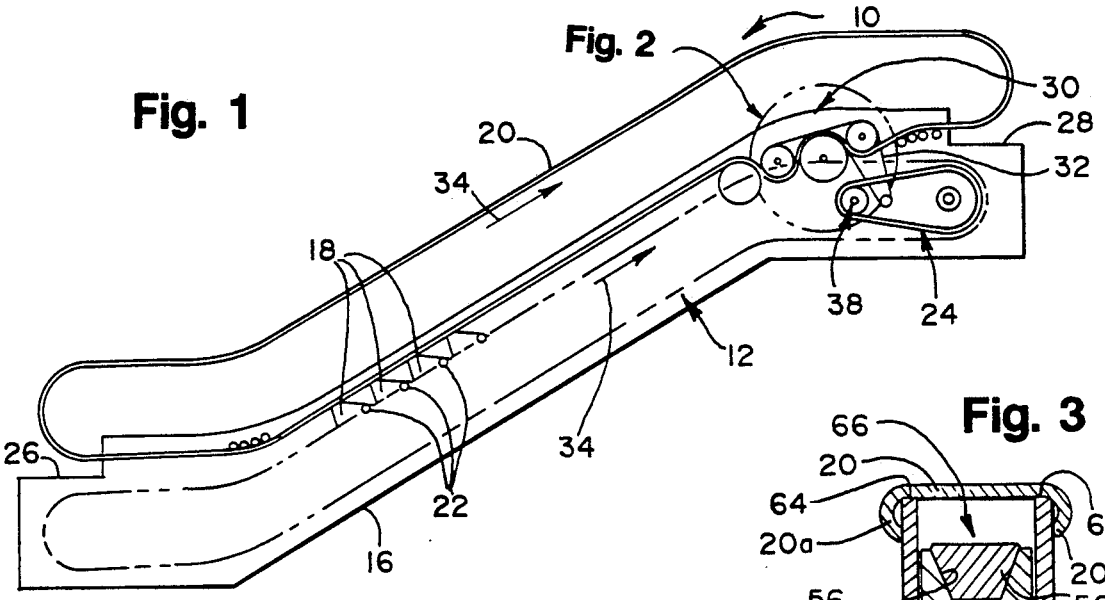
Fig. 3
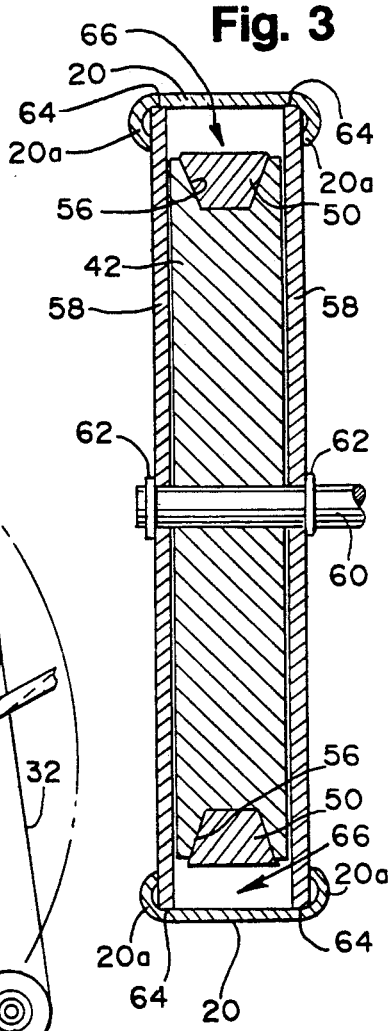
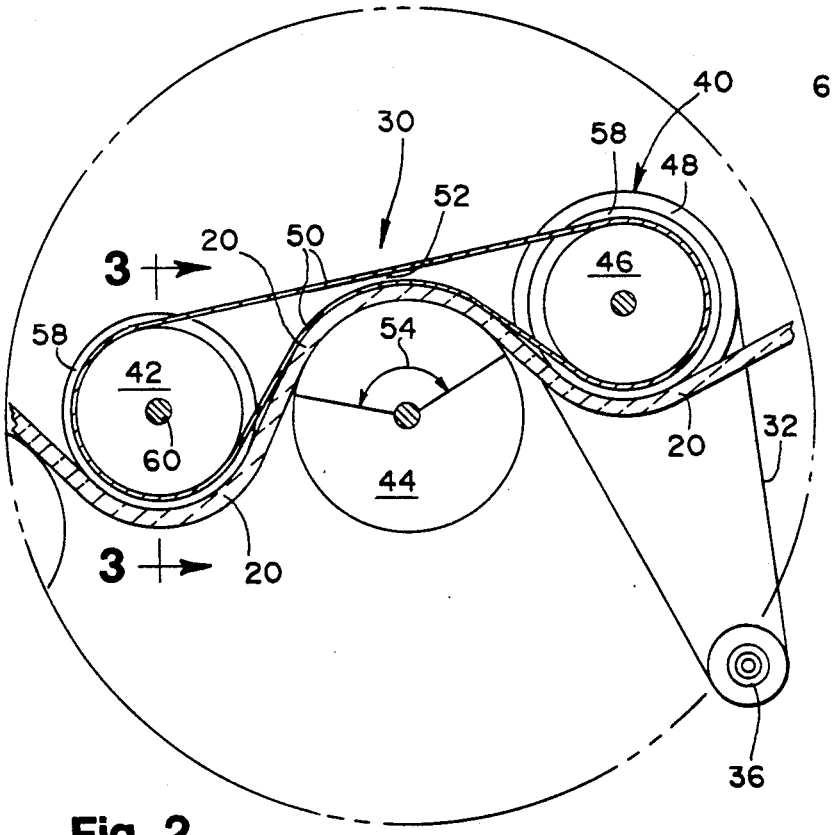
Fig. 2

HANDRAIL DRIVE MECHANISM FOR A PASSENGER CONVEYOR

FIELD OF THE INVENTION

This invention generally relates to the art of passenger conveyors and, particularly, to a drive mechanism for the handrails of such conveyors.

BACKGROUND OF THE INVENTION

A passenger conveyor typically includes a series of passenger platforms which are driven in an endless path between horizontally spaced landings. The most common types of passenger conveyors are escalators and horizontal walkways. Of course, with escalators, the passenger platforms are steps, and the steps are driven in an endless path between lower and upper landings.

In addition to the actual passenger conveying mechanisms, as generally described above, most passenger conveyors include balustrades along opposite sides of the moving passenger platforms, supported by a main body frame of the conveyor, and supporting a pair of handrails movable along and guided by the balustrade constructions.

Passenger conveyors usually include two drive systems operating in synchronism, one drive system for moving the passenger platforms and another drive system for moving the handrails. Handrails drive systems may incorporate wheels, rollers, pulleys, belts and the like, all of which are movable rotationally for moving a linearly movable handrail. Often, a wheel, such as a pulley, will be used to frictionally engage and impart movement to the handrail. A drive belt also might be used, wrapped about a multiple pulley system, including an idler pulley, enabling increased belt wrap and drive capacity, and engaging and imparting linear movement to the handrail. For instance, a handrail may be sandwiched between the outer periphery of an idler pulley and a tensioned drive belt member.

One of the problems with such handrail drive mechanisms as described above, is the continuous wear on the handrail and drive member as it moves through the various pulleys, rollers, and the like. As is commonly known, a handrail is fabricated of flexible material, such as a rubbery material, plastic or the like. When the two distinct but adjacent members move through the various rotating components of the drive system, alternating back and forth bending cause a degree of relative motion between the two members which results in slippage between the handrail and the drive member which engages the handrail. This slippage causes wear of the handrail and drive belt member, not very much different from the wear encountered in tires of an ordinary automobile. Since handrails are an expensive, though replaceable, component of a passenger conveyor system, excessive wear and replacement of handrails is an expensive and time consuming proposition.

This invention is directed to solving the above problems by eliminating slippage between the handrails and their driving components, particularly in a multiple pulley-type handrail drive mechanism.

SUMMARY OF THE INVENTION

An object, therefore, of the invention is to provide a new and improved handrail drive mechanism for a passenger conveyor.

In the exemplary embodiment of the invention, the handrail drive mechanism includes at least one pulley, with a handrail drive belt wrapped about the pulley for rotation with the pulley. Generally, a handrail engaging means is operatively associated with the pulley and about which the handrail is wrapped for movement of the handrail in synchronism with the handrail drive belt. Lost motion means is incorporated between the pulley and the handrail engaging means for allowing differential linear movement between the handrail drive belt and the handrail.

More particularly, as disclosed herein, the handrail engaging means is in the form of slip ring means concentric with the pulley. The slip ring means has a peripheral handrail engaging surface disposed radially outwardly of the pulley for spacing the handrail radially outwardly of the handrail drive belt. Therefore, since the handrail does not engage the drive belt about the periphery of the pulley, any differential movement cannot cause slippage between the handrail and the belt and, therefore, there is no wear on the handrail or drive belt.

In the preferred embodiment of the invention, the slip ring means is provided in the form of a pair of disc-like members disposed with the pulley sandwiched therebetween. The disc-like members may be rotatable relative to the pulley or may be fixed but of low friction material. The handrail is generally C-shaped, whereby the handrail is wrapped about the disc-like members, with the sides of the handrail overlapping the outsides of the members. With the drive belt wrapped about the inner pulley and the handrail wrapped about the larger diameter disc-like members, a gap is provided between the drive belt and the handrail to eliminate any slippage, and resulting wear, between the handrail and the drive belt.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularly in the appended claims. The invention, together with its objects and the advantages thereof, may be best understood by reference to the following description taken in conjunction with the accompanying drawings, in which like reference numerals identify like elements in the figures and in which:

FIG. 1 is a somewhat schematic side elavational view of a typical escalator-type passenger conveyor, incorporating the handrail drive mechanism of the invention;

FIG. 2 is a vertical section, on an enlarged scale, through the handrail drive mechanism which is indicated in the area of the phantom circle "2" in FIG. 1; and FIG. 3 is a vertical section, on a further enlarged scale, taken generally along line 3—3 of FIG. 2.

DETAILED DESCRIPTION OF THE PREFERRED EMBODIMENT

Referring to the drawings in greater detail, FIG. 1 is a schematic illustration of a passenger conveyor in the form of an escalator, generally designated 10. As is generally known, such an escalator includes a stationary frame, generally designated 12, which supports a conveyor assembly having a pair of horizontally spaced chains 16, a plurality of passenger platforms or steps 18 drivingly engaged with the chains, and a pair of horizontally spaced circuitous handrails 20. Each platform 18 is fixed to drive chains 16 and have rollers, as at 22, which run in a rail or track (not shown) mounted on stationary frame 12. Chains 16 are driven by means of a conventional belt drive mechanism, generally designated 24, to continuously move passenger platforms 18 in a closed loop between a lower landing 26 and an upper landing 28. A handrail drive mechanism, generally designated 30, is provided for driving handrails 20 in synchronism with platforms 18. To this end, it can be seen in FIG. 1 that a drive belt 32 is operatively associated between chain drive mechanism 24 and handrail drive mechanism 30. When handrails 20 and drive chains 16 are moved in the directions of arrows 34, a passenger at lower landing 26 steps onto a platform 18 and grasps one of the handrails 20 and the passenger is conveyed upwardly toward upper landing 28.

FIG. 2 shows an enlarged depiction of handrail drive mechanism 30 with drive belt 32 (described in relation to FIG. 1) leading from an appropriate pulley 36 of chain drive mechanism 24. Of course, motor means are provided, as at 38 in FIG. 1, to drive the various drive mechanisms. Again, it should be understood that, up to this point, the conveyor system and its drive systems have been shown somewhat schematically and described accordingly because they are of conventional arrangements and configurations.

Referring to FIG. 2 in greater detail, handrail drive mechanism 30 includes a drive pulley assembly, generally designated 40, a driven pulley 42 and an idler pulley 44. Drive belt 32 is wrapped around drive pulley assembly 40. Drive pulley assembly 40 includes an inner drive pulley 46 and an axially spaced outer drive pulley 48. Drive pulleys 46 and 48 are fixed for conjoint rotation, with drive belt 32 wrapped about drive pulley 48. It should be understood that outer drive pulley 48 is axially spaced (i.e. behind drive pulley 46 as viewed in FIG. 2) sufficiently as not to interfere with handrail 20, for purposes described in greater detail hereinafter.

A handrail drive belt 50 is wrapped about driven pulley 42 and the inner drive pulley 46 of drive pulley assembly 40. The drive belt physically engages those pulleys. Handrail drive belt 50 also is wrapped about idler pulley 44, but it can be seen that handrail 20 is sandwiched between the outer periphery of the idler pulley and the drive belt. It also can be seen that the idler pulley is positioned between drive pulley 46 and driven pulley 42 and spans substantially the entire area between the drive and driven pulleys, at least to the extent that a minimal gap 52 is left between the two opposite runs of the drive belt to prevent engagement therebetween. With this arrangement, a maximum included angle 54 about the periphery of idler pulley 44 is in engagement with handrail 20 to provide normal force and maximum frictional gripping therebetween. In turn, this arrangement provides a maximum gripping area between handrail drive belt 50 and the handrail in the area of that included angle to provide a maximum gripping or driving force on the handrail.

Referring to FIG. 3 in conjunction with FIG. 2, it should be understood that, although FIG. 3 is a section through driven pulley 42 in FIG. 2, the same structural arrangement as will be described, below, is incorporated in drive pulley 46. Therefore, the following description of the arrangement of driven pulley 42 and handrail 50 is equally applicable for the arrangement of drive pulley 46.

More particularly, referring to FIG. 3, driven pulley 42 is shown with handrail drive belt 50 disposed in a complementary groove 56 about the periphery of the circular pulley. Generally, the invention contemplates a handrail engaging means operatively associated with the pulley and about which the handrail is wrapped for movement of the handrail in synchronism with the handrail drive belt, but not in engagement with the drive belt to prevent any physical slippage between the handrail and the belt as the handrail moves about the outside of the pulley. Again, the same is true for drive pulley 46. Still generally, lost motion means is built into the arrangement between pulley 42 and the handrail engaging means for allowing differential linear movement between the handrail drive belt and the handrail.

Specifically, slip ring means in the form of a pair of circular disc-like members 58 are mounted on a shaft 60 in a manner to sandwich pulley 42 therebetween. Appropriate means, such as a pair of lock rings 62, hold the assembly of components axially on shaft 60. Slip discs 58 are freely rotatable about shaft 60 relative to the rotation of pulley 42. It can be seen that the circular outer peripheries 64 of slip discs 58 engage the inside of handrail 20. The handrail is of conventional configuration in that it is generally C-shaped with side edges **20*a* curved inwardly. These side edges are used to advantage in providing means for guiding the handrail about the peripheries of the discs. It can be seen in FIG. 3, that a space, generally designated 66, is provided between the outer periphery of handrail drive belt 50 and the inside of handrail 20. Therefore, all physical slippage between the belt and the handrail is eliminated, contrary to prior art handrail drive mechanisms of this type. Since slip discs 58 are freely rotatable on shaft 60 relative to any rotational movement of pulley 42**, a lost motion means is provided between the slip discs and the pulley for allowing differential linear movement between the handrail and the drive belt.

With an understanding of the construction of the handrail engaging means described in relation to FIG. 3, reference is made back to FIG. 2 to review some of the advantages of the invention. It can be understood that, with slip discs 58 incorporated in both drive pulley 46 and driven pulley 42, there is no engagement between the handrail and drive belt 50 about these pulleys. The driving engagement between drive belt 50 and the handrail is provided at the large included angle area 54 of idler pulley 44. Since the idler pulley, like any idler pulley, is free to rotate, there is no slippage between the handrail and the drive belt in the engagement area thereof about the idler pulley. Consequently, substantially all of the slippage heretofore encountered in handrail drive mechanisms of this type is totally eliminated. As a result, wear on the drive belt also is essentially eliminated, and the life of the drive belt is extended considerably.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a handrail drive mechanism for a passenger conveyor, a drive pulley system comprising:

a pulley;

a handrail drive belt wrapped about the pulley for rotation therewith; and handrail engaging means operatively associated with the pulley and about which the handrail is wrapped for movement of the handrail in synchronism with the handrail drive belt, including lost motion means between the pulley and the handrail engaging means for allowing differential linear movement between the handrail drive belt and the handrail.

2. The drive pulley system of claim 1 wherein said handrail engaging means comprise slip ring means concentric with the pulley.

3. The drive pulley system of claim 2 wherein said slip ring means has a peripheral handrail engaging surface disposed radially outwardly of the pulley for spacing the handrail radially outwardly of the handrail drive belt.

4. The drive pulley system of claim 3 wherein said slip ring means comprise a pair of disc-like members disposed with the pulley sandwiched therebetween, the disc-like members being rotatable relative to the pulley.

5. The drive pulley system of claim 1 wherein said handrail engaging means comprise ring means concentric with the pulley and having a peripheral handrail engaging surface disposed radially outwardly of the pulley for spacing the handrail radially outwardly of the handrail drive belt, at least the handrail engaging surface being of a low friction material.

6. The drive pulley system of claim 1 wherein said pulley comprises one of a drive pulley and a driven pulley of the system, the handrail drive belt being wrapped about both pulleys, and wherein one said handrail engaging means is operatively associated with each pulley.

7. The drive pulley system of claim 6 wherein said handrail engaging means comprise slip ring means concentric with the pulley.

8. In a handrail drive mechanism for a passenger conveyor, a drive pulley system comprising:

a drive pulley;

a driven pulley;

a handrail drive belt wrapped about both said pulleys for rotational movement therewith; and a handrail engaging means operatively associated with each said drive and driven pulleys and about which the handrail is wrapped for movement of the handrail in synchronism with the handrail drive belt, the handrail engaging means of each pulley including lost motion means between the respective pulley and the handrail engaging means thereof for allowing differential linear movement between the handrail drive belt and the handrail.

9. The drive pulley system of claim 8 wherein said handrail engaging means for each pulley comprises a pair of disc-like members concentric with and disposed on opposite sides of each pulley to sandwich the pulley therebetween, the disc-like members being rotatable relative to the respective pulley.

10. The drive pulley system of claim 8 wherein said handrail engaging means comprise ring means concentric with the pulley and having a peripheral handrail engaging surface disposed radially outwardly of the pulley for spacing the handrail radially outwardly of the handrail drive belt, at least the handrail engaging surface being of a low friction material.

11. In a handrail drive mechanism for a passenger conveyor, a drive pulley system comprising:

a pulley;

a drive belt wrapped about the pulley for rotation therewith; and a pair of disc-like members disposed on opposite sides of the pulley to sandwich the pulley therebetween, the handrail being wrapped about the outer peripheries of the disc-like members, and the disc-like members having diameters larger than the diameter of the pulley to space the handrail radially outwardly from the drive belt.

12. The drive pulley system of claim 11 wherein said disc-like members are mounted for rotation relative to the pulley.

13. The drive pulley system of claim 11 wherein the handrail is generally C-shaped with side portions thereof embracing the outsides of the disc-like members.

14. The drive pulley system of claim 11 wherein said disc-like members are fixed to the pulley and are fabricated of low friction material.

15. In a handrail drive mechanism for a passenger conveyor, a drive pulley system comprising:

a drive pulley;

a driven pulley spaced from said drive pulley, generally coplanar with the drive pulley and defining a space therebetween;

an idler pulley disposed between the drive pulley and the driven pulley, generally coplanar with the pulleys and substantially spanning the transverse area between the drive and driven pulleys;

a handrail drive belt wrapped about the pulleys in such a manner that the idler pulley locates one run of the drive belt closely adjacent its other run; and a handrail wrapped about said pulleys in such a manner that the handrail is disposed on the outside of the drive belt about the drive pulley and the driven pulley and the handrail is disposed between the drive belt and the idler pulley whereby, with the idler pulley substantially spanning the area between the drive pulley and the driven pulley, a substantial included angle of engagement is provided between the idler pulley, the handrail and the handrail drive belt.

16. The drive pulley system of claim 15, including handrail engaging means operatively associated with at least one of the drive pulley and the driven pulley and about which the handrail is wrapped for movement of the handrail in synchronism with the handrail drive belt, including lost motion means between said at least one pulley and the handrail engaging means for allowing differential linear movement between the handrail drive belt and the handrail.

17. The drive pulley system of claim 16 wherein said handrail engaging means comprise slip ring means concentric with the pulley.

18. The drive pulley system of claim 17 wherein said slip ring means has a peripheral handrail engaging surface disposed radially outwardly of said at least one pulley for spacing the handrail radially outwardly of the handrail drive belt.

19. The drive pulley system of claim 18 wherein said slip ring means comprise a pair of disc-like members disposed with said at least one pulley sandwiched therebetween, the disc-like members being rotatable relative to the at least one pulley.

20. The drive pulley system of claim 16 wherein said handrail engaging means comprise ring means concentric with the pulley and having a peripheral handrail engaging surface disposed radially outwardly of the pulley for spacing the handrail radially outwardly of the handrail drive belt, at least the handrail engaging surface being of a low friction material.

* * * * *